US005501457A

United States Patent [19]

Ogihara

[11] Patent Number: 5,501,457

[45] Date of Patent: Mar. 26, 1996

[54] GAME APPARATUS

[75] Inventor: Nobuaki Ogihara, Kawaguchi, Japan

[73] Assignee: Hasbro, Inc., Pawtucket, R.I.

[21] Appl. No.: 377,543

[22] Filed: Jan. 23, 1995

[51] Int. Cl.[6] ..... A63B 71/02

[52] U.S. Cl. ..... 273/127 C

[58] Field of Search ..... 273/459, 127 R, 273/127 C, 179, 374, 395, 138 R

[56] References Cited

U.S. PATENT DOCUMENTS 1,897,289 2/1933 Wieden .

5,154,426 10/1992 Black .

*Primary Examiner*—Paul E. Shapiro

*Attorney, Agent, or Firm*—Kurt R. Benson

[57] ABSTRACT

A game apparatus includes an animated character figure which is adapted to be received on a supporting surface so that a game ball is receivable in an open mouth thereof. The apparatus further includes a drive mechanism in the character figure which is operative in response to passage of the game ball into the open mouth for closing the mouth, ejecting the game ball, rotating the character figure on the supporting surface and then returning the mouth to an open position.

8 Claims, 11 Drawing Sheets

GAME APPARATUS

BACKGROUND AND SUMMARY OF THE INVENTION

The instant invention relates to amusement games and more particularly to a game apparatus which is adapted for use in a golfing-type amusement game.

It has generally been recognized that amusement games which incorporate amusing and exciting action game apparatus often have increased levels of appeal. It has also been recognized that game apparatus which are adapted to be incorporated into competitive action games which require game players to skillfully perform certain activities in order to achieve game scores frequently have high levels of appeal. Even further, it has been found that game apparatus of these types which are adapted for use in games which are patterned after popular known forms of athletic activities, such as those associated with golf, baseball, or football, have even still further increased levels of appeal.

The instant invention provides a highly amusing game apparatus which is adapted for use in a simulated golfing-type game. More specifically, the instant invention provides a highly amusing game apparatus comprising an animal character figure which is adapted for receiving game elements, such as simulated golf balls, therein and for individually ejecting the game elements. Further, the game apparatus of the instant invention is preferably adapted so that when a simulated golf ball passes through the open mouth of the character figure embodied therein, the mouth is automatically moved to a closed position and the simulated golf ball is ejected by flipping it into the air so that it passes over the head of the character figure. Still further, the apparatus is preferably adapted so that as a simulated golf ball is ejected, the character figure is rotated about a substantially vertical axis so that it is repositioned in a different direction with respect to the game player who originally hit the ball into the open mouth of the character figure. Accordingly, the game apparatus is repositioned each time a game player receives a score by passing a game ball through the open mouth of the character figure. As a result, the next game player must generally take one or more extra game strokes to align the ball with the mouth of the character figure before another game point can be scored.

Apparatus representing the closest prior art to the subject invention of which the applicant is aware is disclosed in the U.S. Pat. Nos. to Wieden, 1,897,289, and Black, 5,154,426. However, since these references fail to even suggest the concept of a golf-type game apparatus comprising a character figure which is adapted for receiving a simulated golf ball through an open mouth thereof and for then ejecting the ball, they are believed to be of only general interest with respect to the subject invention.

More specifically, the game apparatus of the instant invention includes a game element which is preferably embodied as a simulated golf ball and a housing, including a character figure head portion having upper and lower jaw portions which cooperate to form a mouth. At least one of the upper and lower jaw portions is pivotable for moving the mouth between open and closed positions, and the housing is adapted to be received on a supporting surface so that the lower jaw portion rests thereon when the mouth is in an open position. Still further, the lower jaw portion is formed so that when the character figure is received on a supporting surface with the lower jaw portion resting thereon, the lower jaw portion functions as a ramp which leads from the supporting surface to an area behind the mouth when the mouth is in the open position. The apparatus still further comprises an ejecting mechanism which is operative for ejecting a game ball once it has passed through the open mouth portion. The ejecting mechanism is preferably operative for ejecting a game element by tossing it through the air so that it passes over the head portion of the character figure embodied in the game apparatus. Still further, the apparatus preferably includes a mouth control mechanism for moving the mouth to a closed position as soon as a game element has passed therethrough and a rotating mechanism for rotating the character figure about a substantially vertical axis as the game ball is ejected. Further, the character figure preferably comprises a simulated alligator character figure having an upper jaw portion which is pivotable for moving the mouth thereof between open and closed positions.

It has been found that the game apparatus of the instant invention can be effectively utilized in a highly amusing golf-type game in which game players are required to pass a simulated golf ball through the open mouth of the alligator character figure embodied in the apparatus in order to score game points. It has been further found that the exciting action of the game apparatus when a game point is scored significantly enhances the overall appeal thereof. Specifically, it has been found that the action of the mechanism of the apparatus for immediately closing the mouth of the character figure, tossing the received ball into the air, and rotating the character figure about a substantially vertical axis adds a high level of excitement and appeal to the use of the game apparatus.

Accordingly, it is a primary object of the instant invention to provide an effective and amusing golf-type game apparatus for use by children.

Another object of the instant invention is to provide a game apparatus embodying an action character figure which is operative for receiving a game ball through an open mouth thereof and for then closing the mouth, ejecting the game ball, and rotating the character figure about a vertical axis.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
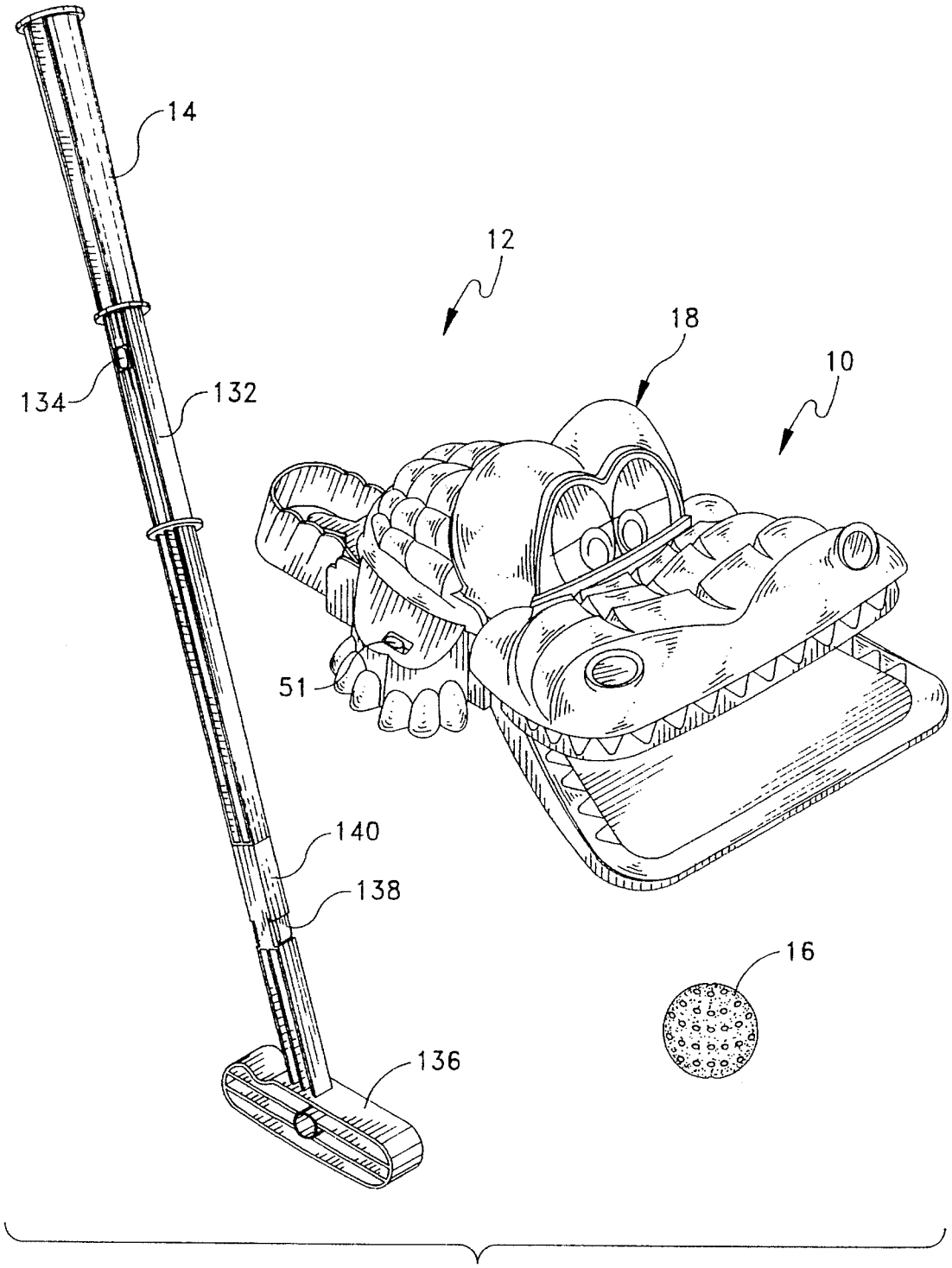
FIG. 1 is a perspective view of the game apparatus of the instant invention.
Figure 2:
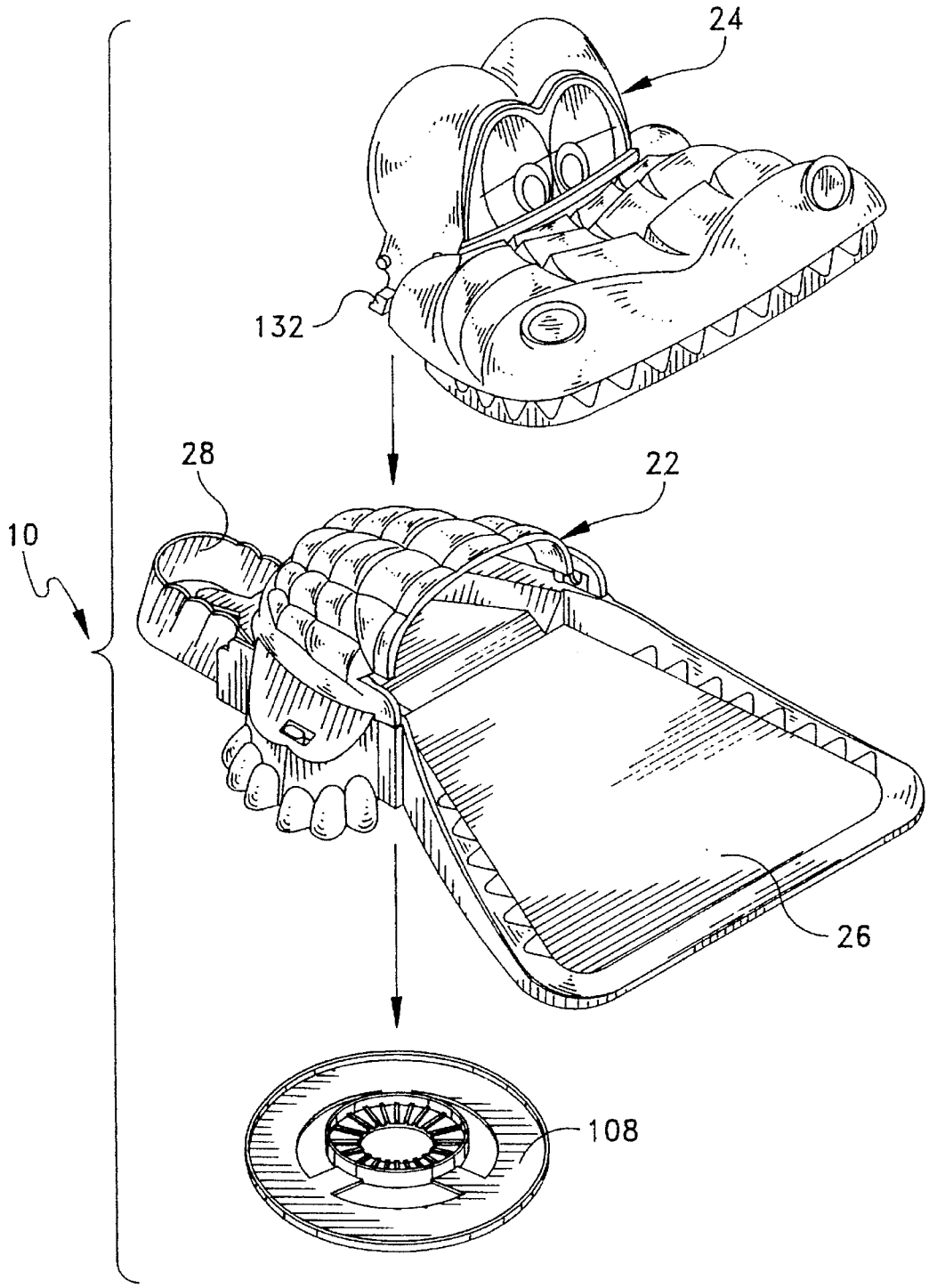
FIG. 2 is an exploded perspective view of the housing and rotator disc platform thereof.
Figure 3:
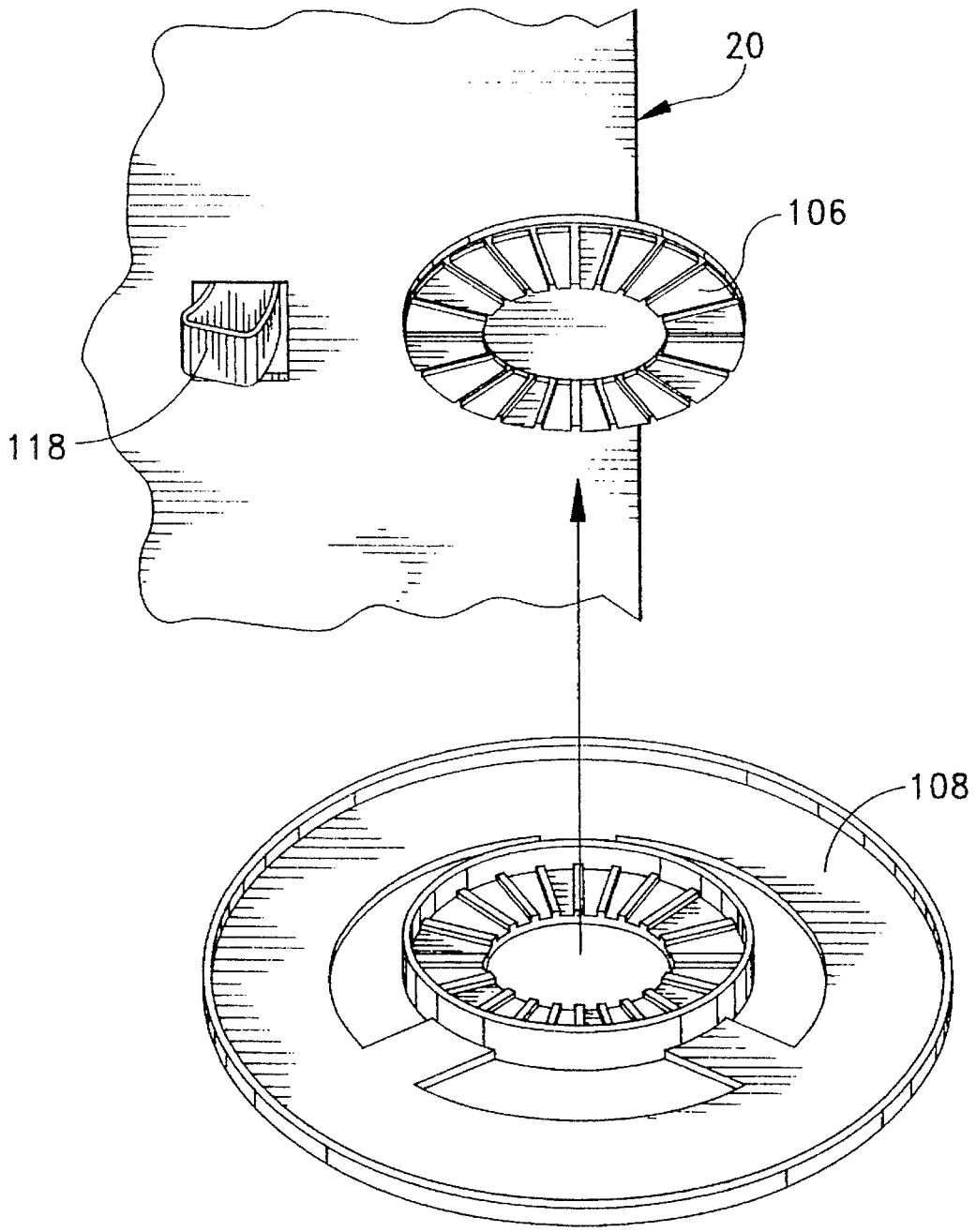
FIG. 3 is a bottom perspective view of the housing and the rotator disc platform.
Figure 4:
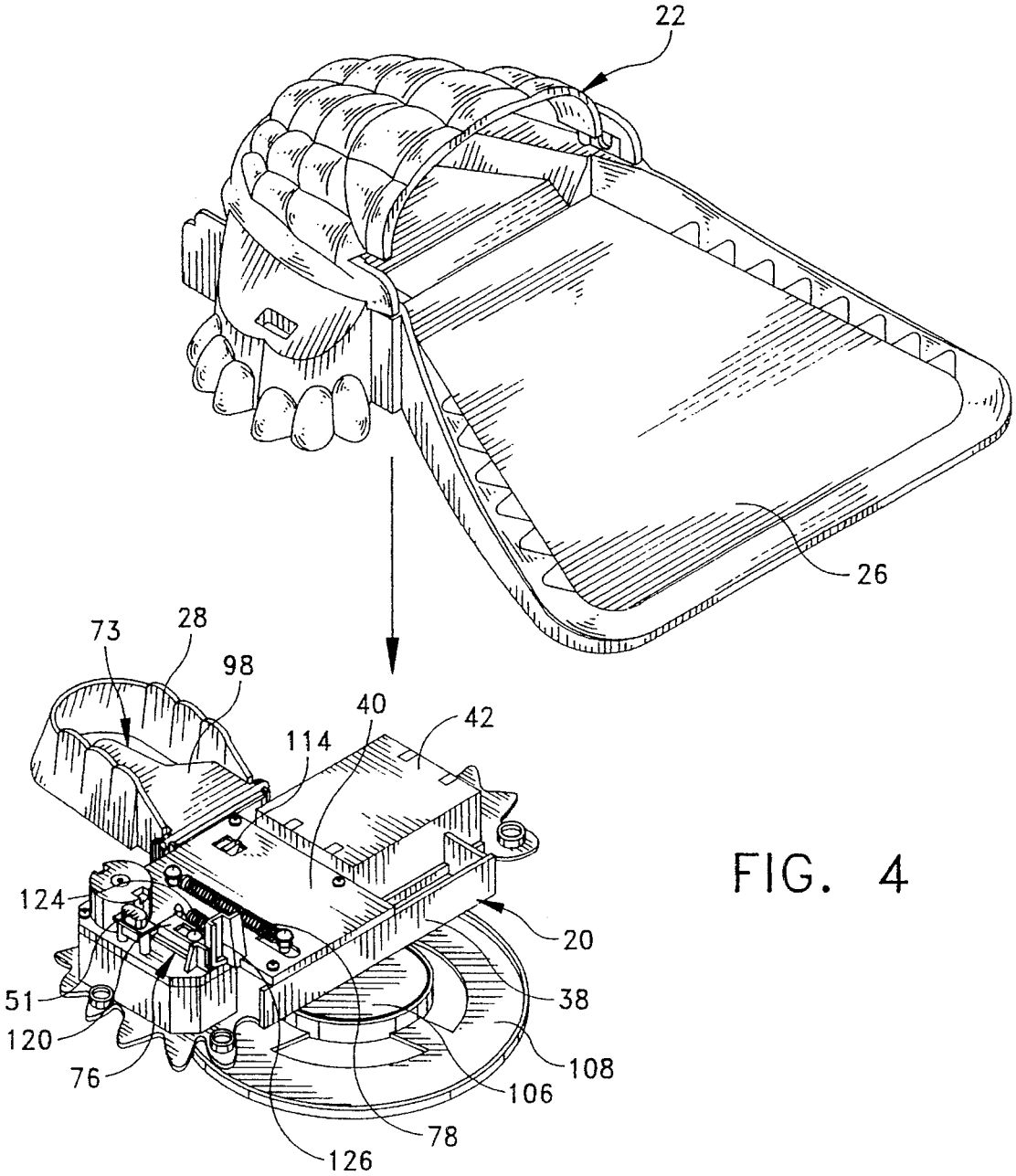
FIG. 4 is a perspective view of the operating mechanism with the main housing portion removed.
Figure 5:
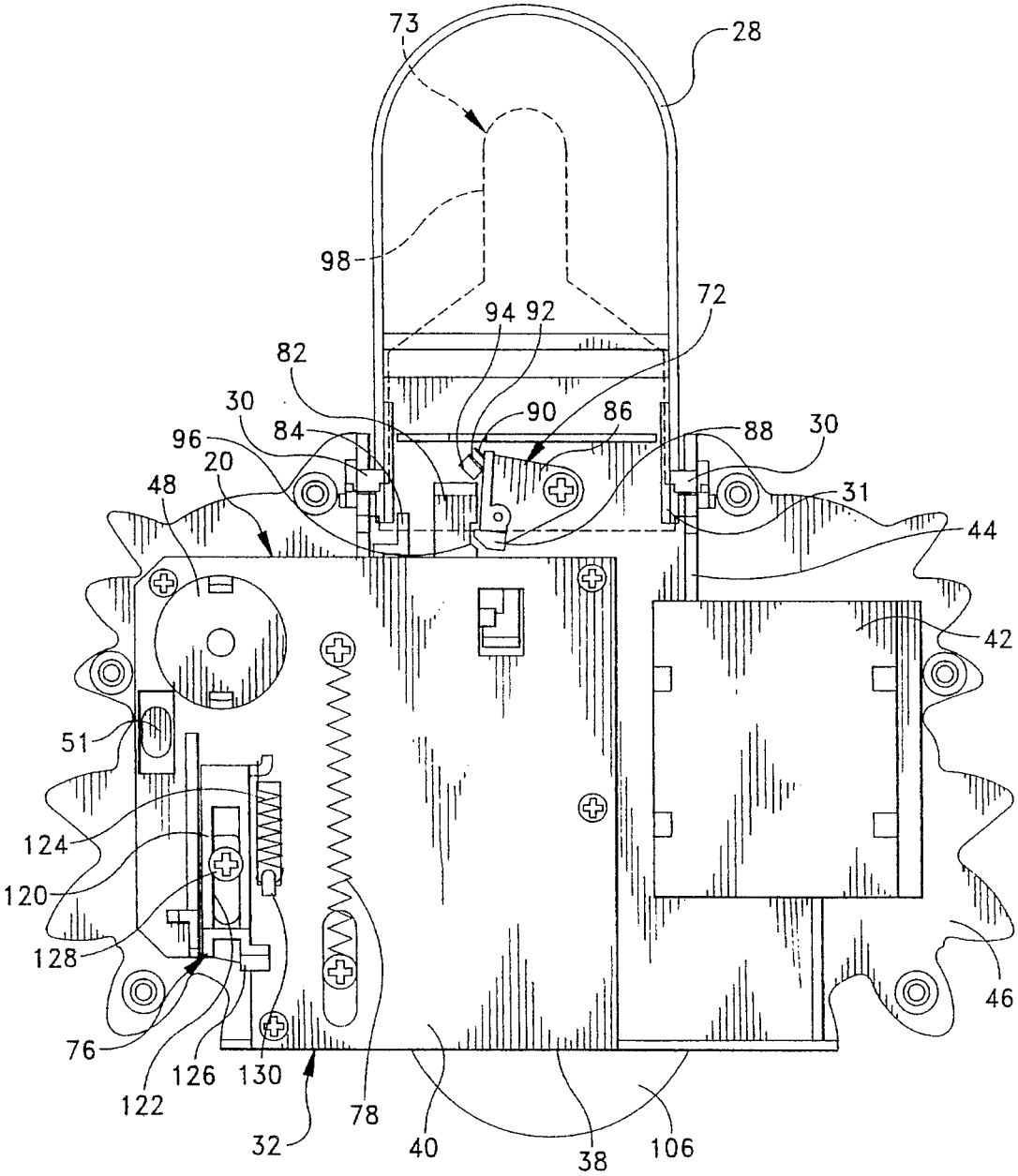
FIG. 5 is a top plan view of the operating mechanism.

Referring now to the drawings, the game apparatus of the instant invention is illustrated in FIGS. 1–14 and generally indicated at 10 in FIGS. 1, 2 and 9–12. As illustrated in FIG. 1, the apparatus 10 is operative as part of a play assembly generally indicated at 12 which also includes a simulated golf club 14 and a simulated golf ball 16. Accordingly, the apparatus 10 is adapted for use in a golf-type game in which game players are required to attempt to pass the ball 16 into the interior of the apparatus 10 by striking the ball 16 in a conventional manner utilizing the club 14. The apparatus 10 is adapted for receiving the ball 16 therein during the course of game play and for thereafter automatically ejecting the ball 16 and reorienting the apparatus 10 on a playing surface.

The apparatus 10 as herein embodied comprises an animated character figure which is adapted to resemble a fanciful alligator character, and it includes an outer housing generally indicated at 18 and a drive mechanism generally indicated at 20 which is contained in the housing 18. Specifically, the drive mechanism 20 is operative for moving the mouth of the character figure embodied in the apparatus 10 between open and closed positions. The mechanism 20 is further operative for receiving the ball 16 in the apparatus 10 and for thereafter ejecting it in a forward direction therefrom. Still further, the mechanism 20 is operative for rotating the apparatus 10 on a supporting surface as the ball 16 is ejected therefrom so that the character figure embodied in the apparatus 10 is reoriented relative to one or more game players.

The housing 18 comprises a lower jaw and body assembly generally indicated at 22 and an upper jaw and head assembly generally indicated at 24. The lower jaw and body assembly 22 includes a ramp-like lower jaw element 26 which is adapted so that it extends upwardly into the interior of the apparatus 10 when the apparatus 10 is received on a supporting surface. Accordingly, the ramp-like lower jaw element 26 is adapted so that the forward extremity thereof is positioned adjacent a supporting surface when the apparatus 10 is received thereon as will hereinafter be more fully set forth. The upper jaw and head assembly 24 is pivotally attached to the lower jaw and body assembly 22 so that the upper jaw and head assembly 24 is movable between open and closed positions to simulate the open and closed positions of the mouth of the alligator-like character figure embodied in the apparatus 10. The housing 18 further comprises a rear or tail portion 28 which is formed in a relatively short open rounded configuration and extends rearwardly from the lower jaw and body assembly 22 as illustrated. In this regard, as illustrated in FIGS. 5–8, the rear or tail portion 28 is actually attached to the lower jaw and body assembly 22 through the drive assembly 20, and it includes a pair of mounting pins 30 which are pivotally received in notches in the drive assembly 20 for mounting the tail portion 28 so that it is at least slightly upwardly pivotable for simulating a tail flipping action during operation of the apparatus 10.

The drive assembly 20 comprises a drive assembly housing generally indicated at 32, a gear assembly generally indicated at 34, and a cam plate assembly generally indicated at 36 including a cam plate 37. During operation of the drive assembly 20, the gear assembly 34 is operative for moving the cam plate assembly 36 to a loaded position and for then releasing the cam assembly 36 to eject a ball 16 received in the tail portion 28 and to effect rotation of the apparatus 10 so that it is repositioned on a supporting surface.

The housing 32 includes a main housing portion 38 in which the gear assembly 34 is received, an access or cover plate 40 on the main portion 38, a battery housing portion 42 having an access plate (not shown) on the underside thereof, a tail mounting portion 44, and a perimeter or base portion 46.

The gear assembly 34 comprises a drive motor 48 having a drive gear 50 thereon, a power switch 51, a first transmission gear 52 having a first pinion gear 54 thereon, a second transmission gear 56 having a second pinion gear 58 thereon, a third transmission gear 60 having a third pinion gear 61 thereon, and a fourth transmission gear 62 having a fourth pinion gear 64 thereon. The gears 50 through 64 are operative for communicating rotation from the drive motor 48 to a cam gear 66 so that the cam gear 66 rotates in the direction indicated. The gear assembly 34 further comprises a rotator disc drive gear 68 which also engages the cam gear 66 during rotation thereof. The cam gear 66 includes an upwardly extending cam element 70 which is engageable with the cam plate 37 in order to effect movement thereof in the directions indicated.

The cam plate assembly 36 includes the cam plate 37, a rear actuator assembly 72, a tilt lever generally indicated at 74, a jaw pivot assembly generally indicated at 76, and a spring 78. The cam plate 37 includes a cam follower opening 80 in which the cam element 70 is received, and accordingly, as the cam gear 66 is rotated in the direction indicated, the cam 70, the spring 78, and the cam follower opening 80 cooperate to move the cam plate 37 in forward or rearward directions depending on the orientation of the cam element 70 in the opening 80. The cam follower opening 80 includes a ridge 81 where the cam element 70 normally comes to rest after the mechanism 20 has completed an operating cycle as will hereinafter be more fully set forth. The cam plate 37 has primary and secondary rear actuator legs 82 and 84, respectively, thereon. The first rear actuator leg 82 is engageable with the actuator assembly 72 for controlling the operation of the drive motor 48 whenever the switch 51 is in an on position. In this regard, the actuator assembly 72 includes an actuator plate 86 having a cam element 88 thereon, and first and second resilient contacts 90 and 92 which are attached to the underside of the cam plate 86. The second contact 92 has a contact cam 94 thereon which is engageable with the end of the first actuator leg 82 for moving the second contact 92 into engagement with the first contact 90 in order to effect electrical communication therebetween. The contacts 90 and 92 are electrically connected in series relation in a wire (not shown) leading from the battery housing 42 to the switch 51, and accordingly, the contacts 90 and 92 function as a secondary switch which is operative for energizing and deenergizing the motor 48 when the power switch 51 is in an "on" position. Further, the switch formed by the contacts 90 and 92 is responsive to the movement of the first actuator leg 82 for energizing and deenergizing the motor 48. In this regard, the contact elements 90 and 92 are constructed so that when the cam plate 37 is in the forward position illustrated in FIGS. 5 and 6, the contact elements 90 and 92 are maintained in spaced relation. However, when the cam plate 37 is moved to a rearward position, the contacts 90 and 92 are moved into engagement by the contact cam 94 and the first leg 82. In addition, as will be seen from FIGS. 5 and 6, the first leg 82 has a notch 96 formed in the side thereof and the actuator cam 88 is received in the notch 96 when the cam plate 37 is in the forward position thereof. However, when the cam plate 37 is moved to the rearward position thereof, the actuator cam 88 is cammed out of the notch 96, and by doing so, the actuator plate 86 operates to apply additional pressure to the contact 90 in order to maintain the contacts 90 and 92 in engagement whenever the cam plate 37 is in the rearward position thereof. However, once the cam plate 37 is returned to the forward position thereof, actuator cam 88 again passes into the notch 96, and the contact cam 94 is disengaged from the leg 82 so that the contacts 90 and 92 are resiliently returned to disengaged positions. Accordingly, because of the configuration of the cam follower opening 80, the actuator assembly 72 and the cam plate 37 cooperate to maintain the motor 48 in an energized state throughout approximately an entire revolution of the cam gear 66.

The ejector assembly 73 is controlled by the second rear actuator leg 84. The ejector assembly 73 comprises an ejector plate 98 having a pair of outwardly extending mounting posts 100 thereon which are rotatably received in correspondingly formed notches in the rear actuator housing section 44. The actuator plate 98 also includes a downwardly extending finger 102 which is engageable with the first contact 90 to temporarily move it into engagement with the second contact 92 and a pair of triangular shaped tabs 104. Accordingly, by applying a slight temporary downward force to the ejector plate 98, the finger 102 is pivoted so as to cause temporary engagement of the contacts 90 and 92 and to thereby effect temporary energization of the motor 48. Further, as the contact 90 is moved into engagement with the second contact 92 by the finger 102, the actuator plate 86 is pivoted slightly so as to move the actuator cam 88 out of the notch 96 on the leg 82. Therefore, when the motor 48 is temporarily energized so that the cam 70 travels along the ridge 81 causing the cam plate 37 to move forwardly slightly, the notch 96 is moved out of alignment with the actuator cam 88. As a result, once the cam 70 passes over the cam ridge 81, the actuator cam 88 and the leg 82 cooperate to maintain the first and second contacts 90 and 92 in engagement so that the motor 48 remains energized. In any event, as the cam 70 passes over the ridge 81, the cam plate 37 is rapidly propelled in a rearward direction causing the second leg 84 to strike one of the triangular-shaped tabs 104 and thereby causing the ejector plate 98 to be rapidly pivoted upwardly. As a result, when the bail 16 is received in the rear housing portion 28 so that it is positioned on the ejector plate 98 and the cam plate 37 is propelled rearwardly into engagement with one of the tabs 104, the bail 16 is ejected upwardly in a generally forward direction from the apparatus 10. Further, when the cam plate 37 is propelled rearwardly in this manner, the second leg 84 also engages the left side contact plate 31 of the rear housing section 28 causing the rear housing section 28 to be pivoted upwardly slightly so as to provide a simulated tail flipping action in the character figure embodied in the apparatus 10. In any event, once the cam 70 has passed over the ridge 81 causing the cam plate 37 to be propelled rearwardly, the rear leg 82 maintains the contacts 90 and 92 in engagement so that the motor 48 remains energized until the cam gear 66 has been rotated to a point where the cam element 70 is positioned just before the ridge 81 in the cam opening 80.

Also included in the drive assembly 20 is a rotator disk 106 which is mounted on a common shaft with the rotator disk drive gear 68. The rotator disk 106 is mounted on the underside of the housing 32 so that it is engageable with a supporting surface for rotating the apparatus 10 whenever the motor 48 is energized. An optional enlarged rotator disk platform 108 is also included in the drive assembly 20 for adapting the apparatus 10 for use on high pile carpeted surfaces. As illustrated most clearly in FIG. 3, the rotator disk platform 108 is receivable in nonrotatable engagement on the underside of the rotator disk 106 for supporting the apparatus 10 on a supporting surface.

Figure 6:
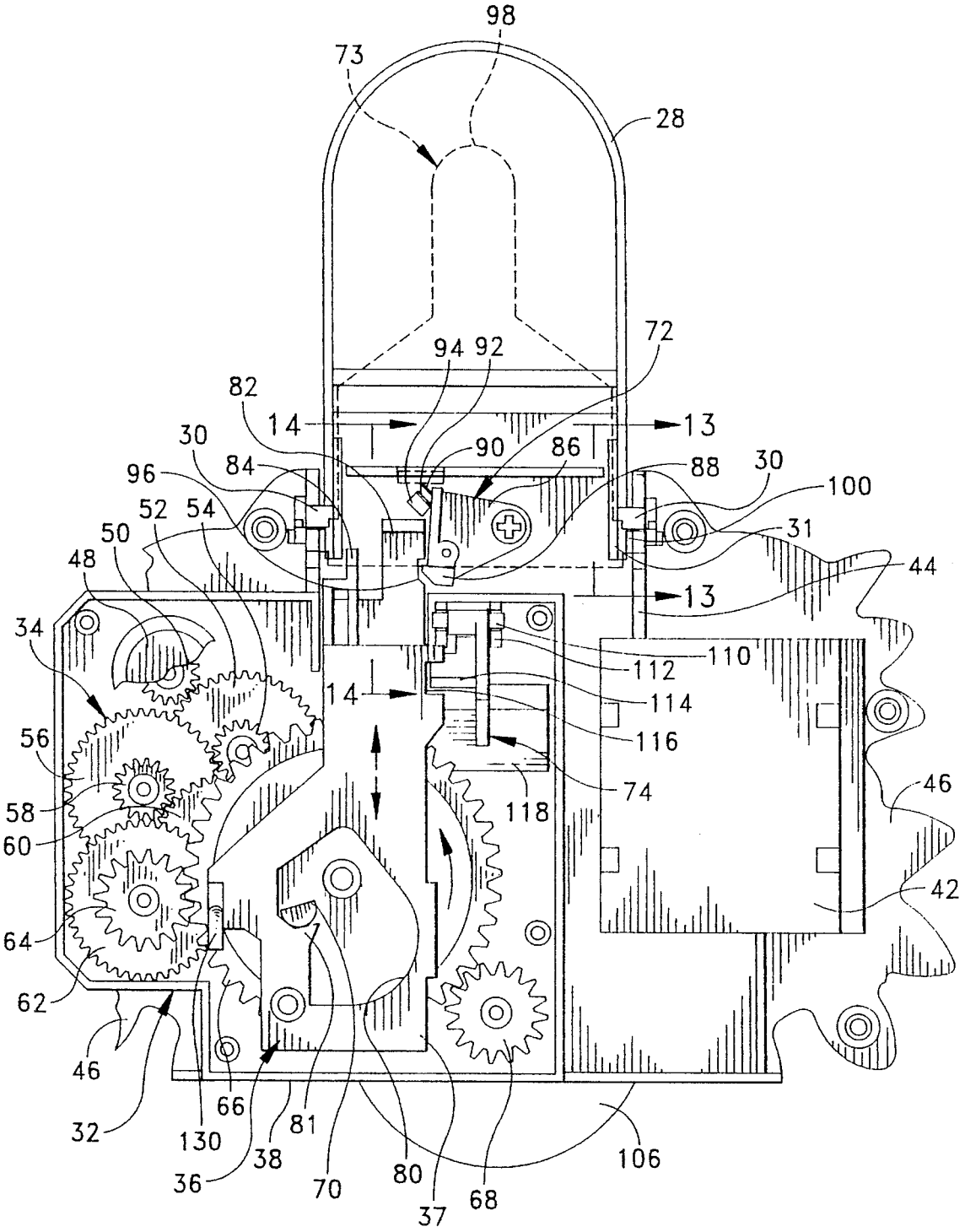
FIG. 6 is a top plan view of the operating mechanism with the housing cover thereof removed.
Figure 7:
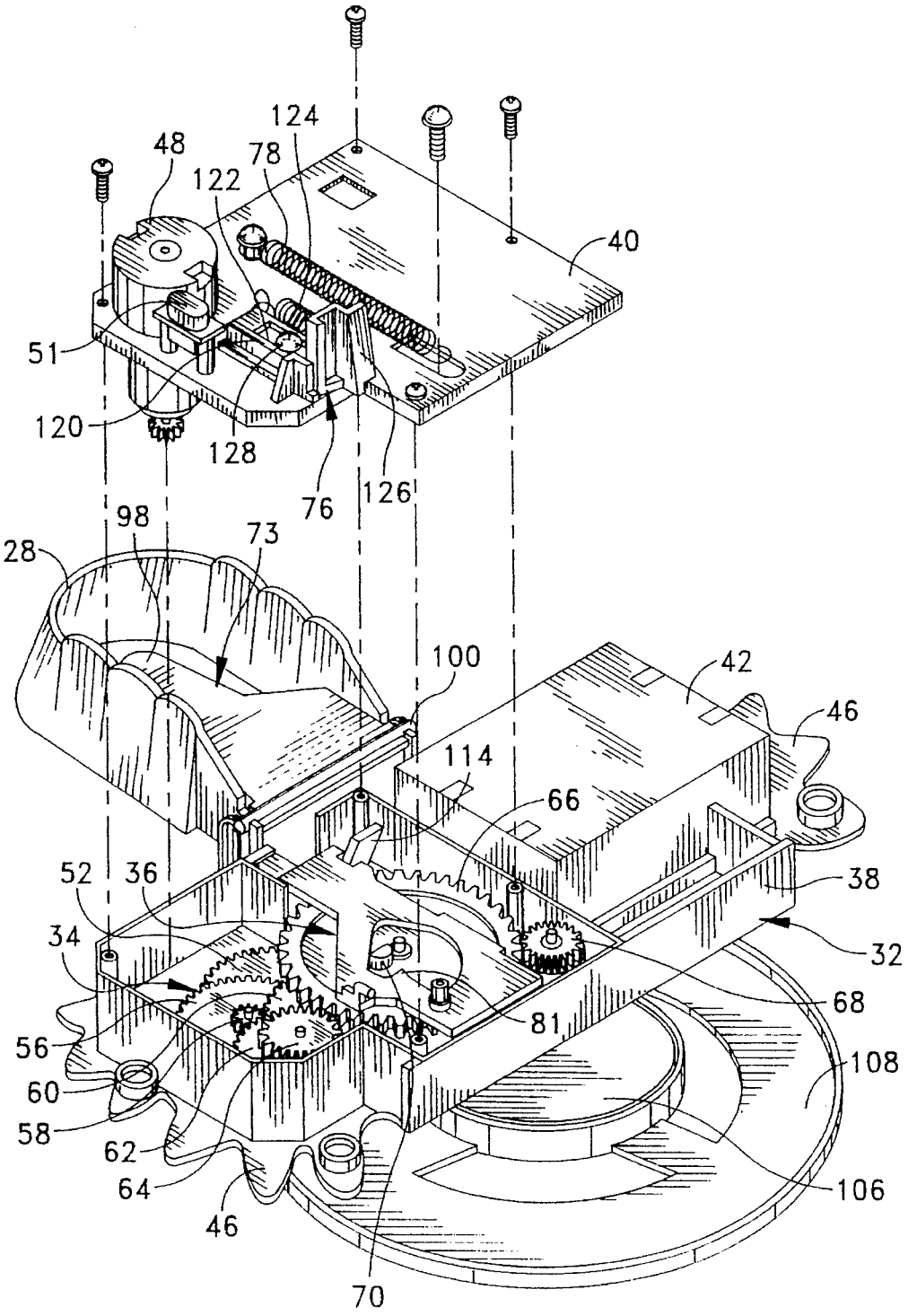
FIG. 7 is an exploded perspective view of the operating mechanism.
Figure 8:
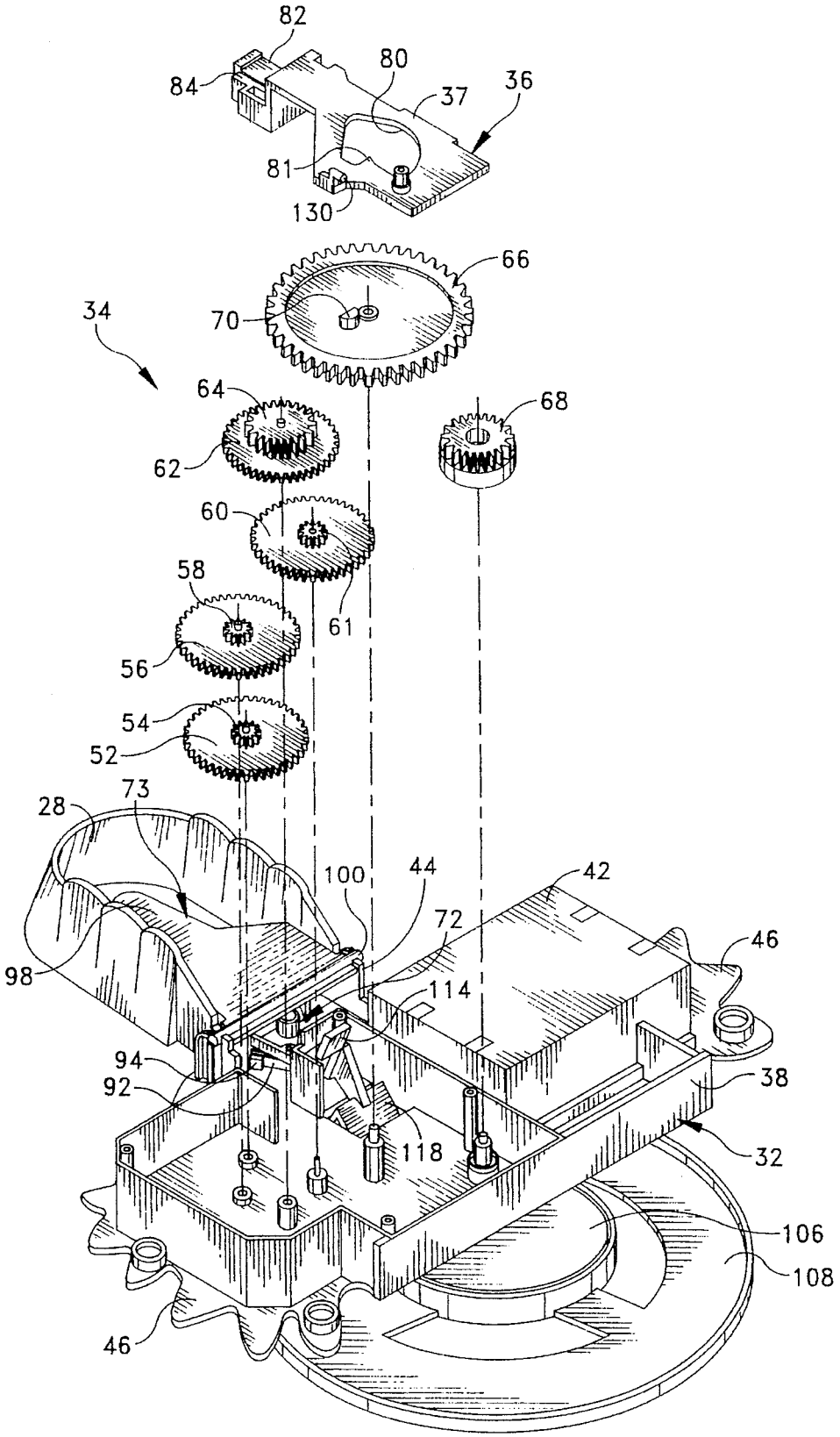
FIG. 8 is a further exploded perspective view thereof.
Figure 9:
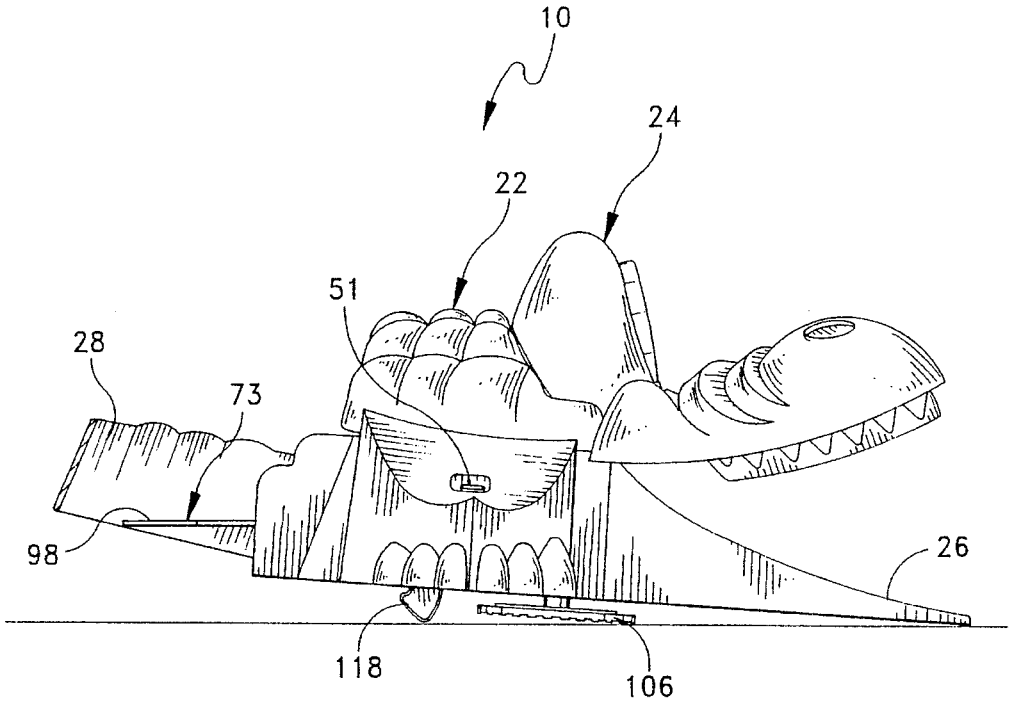
FIGS. 9–11 are side elevational views illustrating the operation of the apparatus.
Figure 10:
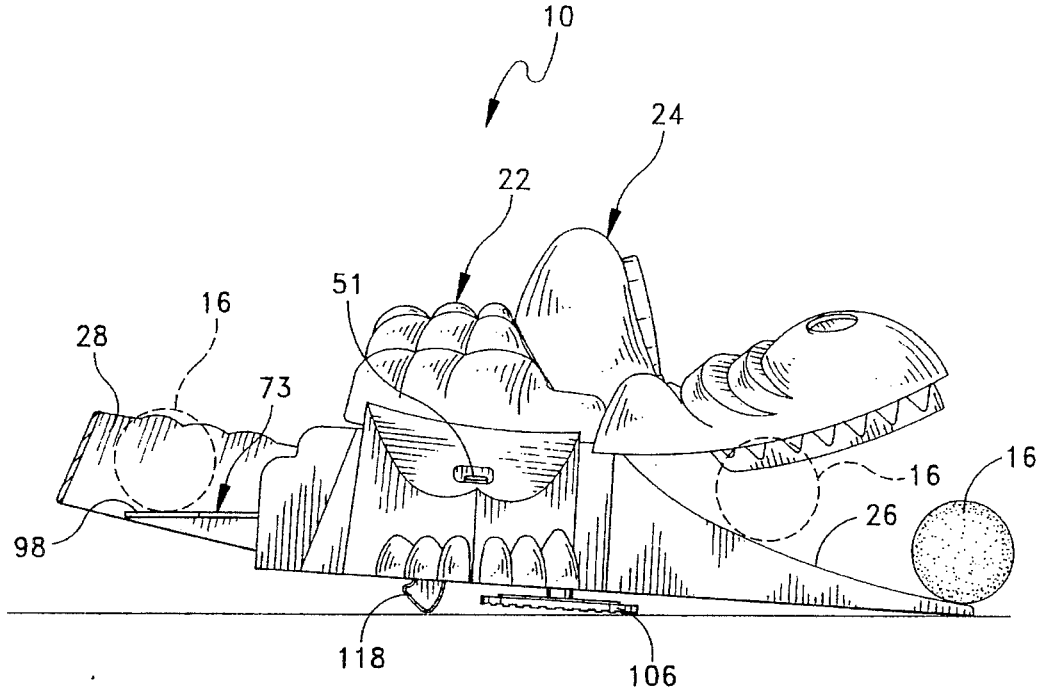
Figure 11:
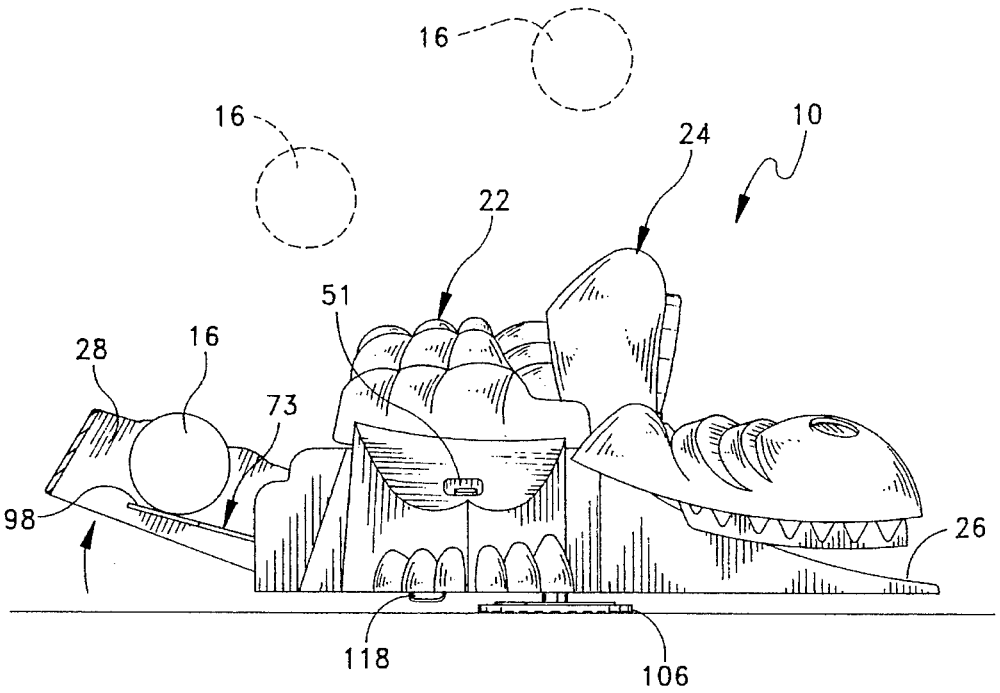
Figure 12:
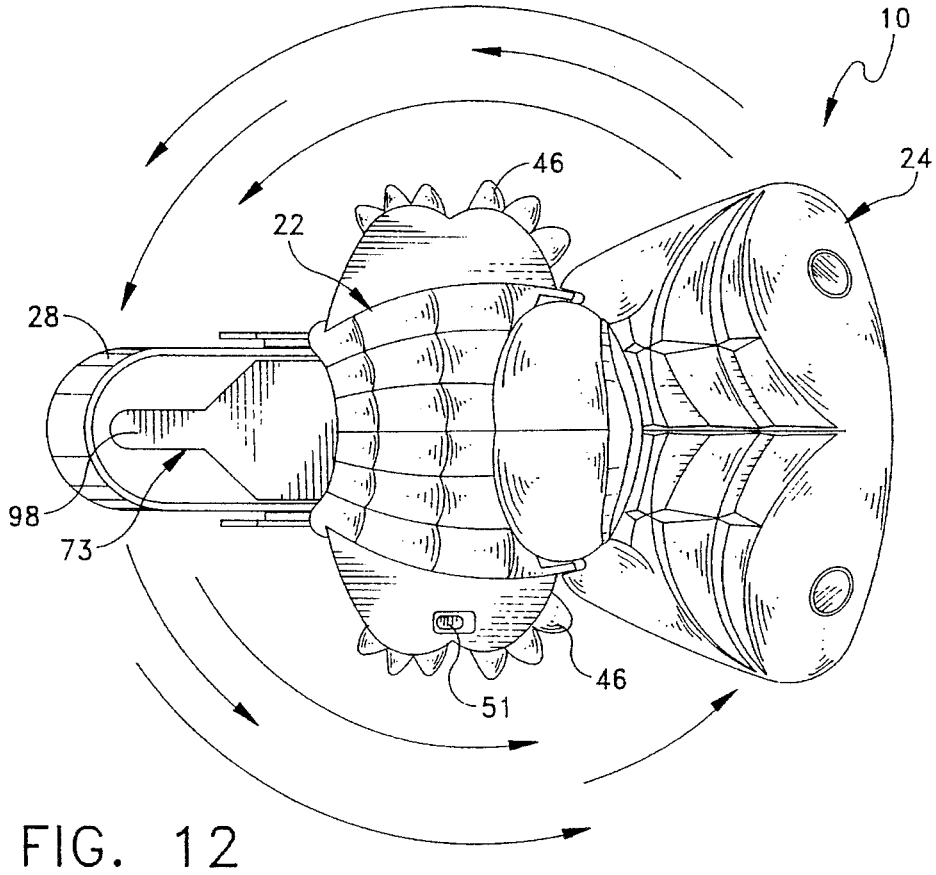
FIG. 12 is a top plan view illustrating the operation thereof.
Figure 13:
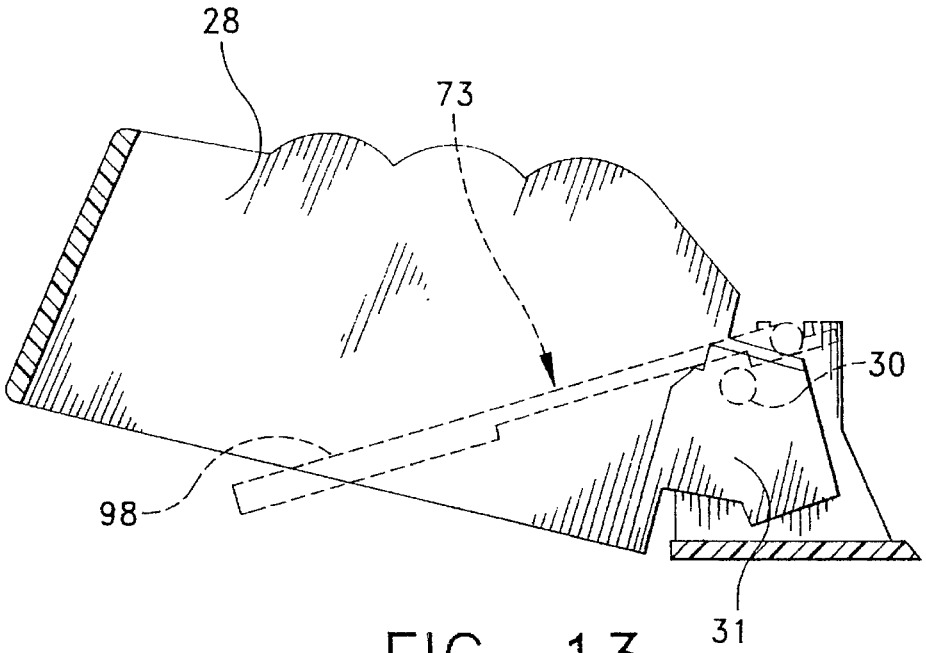
FIG. 13 is a sectional view taken along line 13—13 in FIG. 6.
Figure 14:
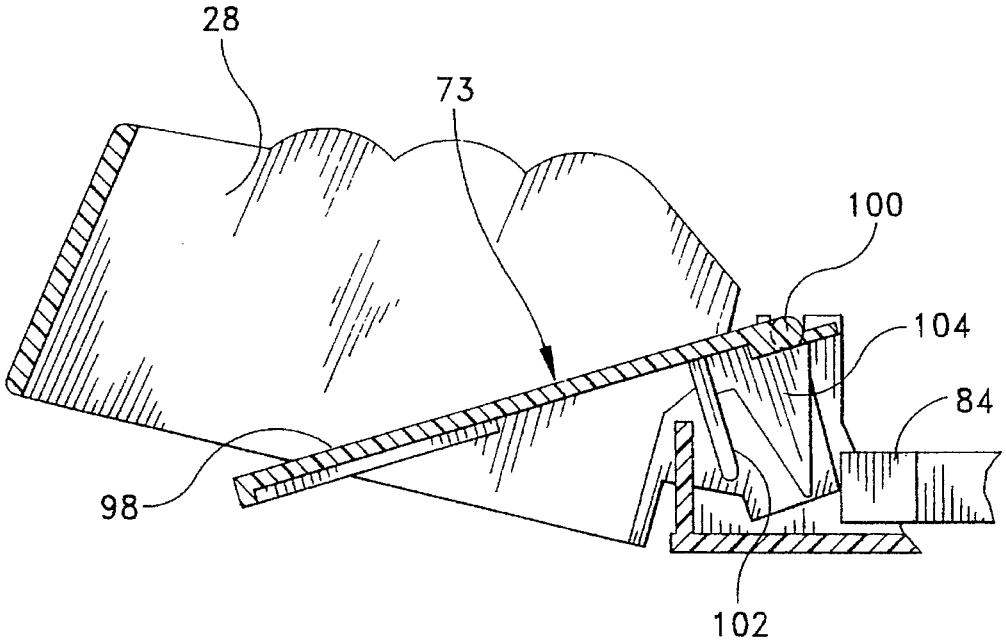
FIG. 14 is a sectional view taken along line 14—14 in FIG. 6.

Still further included in the drive assembly 20 is the tilt lever 74. As illustrated in FIG. 6, the tilt lever 74 includes a pair of pivot pins 110 which are rotatably received in pivot mounts 112 in the housing 32. The tilt lever 74 further includes an actuating finger 114 which is received in a notch 116 in the cam plate 37 and a foot portion 118 which is received in an opening on the underside of the housing 32. Accordingly, as the cam plate 37 is moved between the forward and rearward positions thereof, the finger 114 is engaged by the cam plate 37 in the notch 116 to pivot the tilt lever 74. Specifically, when the cam plate 37 is in the forwardmost position thereof, the tilt lever 74 is located in a position in which the foot portion 118 thereof extends downwardly from the underside of the housing 32 as illustrated in FIGS. 9 and 10. However, when the cam plate 37 is shifted to the rearward position thereof, the foot portion 118 is retracted upwardly to the position illustrated in FIG. 11 so that the apparatus 10 can be more freely rotated on the rotator disk 106. In other words, when the cam plate 37 is positioned so that the cam element 70 is in engagement with the ridge 81 so that the motor 48 is normally in a deenergized condition, the foot portion 118 operates to tilt the apparatus 10 forwardly slightly to position the forward edge of the lower jaw element 26 adjacent a supporting surface for more effectively receiving the ball element 16 in the apparatus 10. However, once the cam element 70 has passed over the ridge 81 so that the cam plate 37 is shifted rearwardly by the spring 78, the foot portion 118 is retracted upwardly to the position illustrated in FIG. 11 so that the apparatus 10 is free to rotate on a supporting surface in the manner illustrated in FIG. 12. It should be noted, however, that when the rotator disk platform 108 is assembled on the rotator disk 106, the effect of the foot portion 118 for tilting the apparatus 10 forwardly is essentially nullified. However, since the rotator disk platform 108 is normally only used when the apparatus 10 is operated on a high pile carpeted surface, it is generally not necessary to tilt the apparatus 10 forwardly to position the lower jaw portion 26 adjacent a supporting surface when the rotator disk platform 108 is assembled on the rotator disk 106.

The jaw pivot assembly 76 is mounted on the cover plate 40 and it includes a slide portion 120 having an open slot 122 therein, a spring 124, and a pivot lever portion 126. The slide portion 120 is slideably mounted on the cover plate 40 by means of a mounting post (not shown) which extends upwardly from the cover plate 40 through the slot 122 and a screw 128 which is received in threaded engagement in the mounting post. One end of the spring 124 is connected to the slide portion 120 and the opposite end thereof is connected to a hook 130 which extends upwardly from the cam plate 37 and through a slot in the cover plate 40. The spring 124 functions primarily as a connecting linkage between the cam plate 37 and the slide portion 120 so that the slide portion 120 moves forwardly and rearwardly with the cam plate 37, although when the cam plate 37 is in the forwardmost position thereof, the spring 124 actually operates to resiliently bias the slide portion 120 toward a forward position. The pivot lever portion 126 extends integrally upwardly from the slide portion 120, and it engages a lug 132 on the upper jaw and head assembly 24 for pivoting the upper jaw and head assembly 24 to an open position when the slide portion 120 and the pivot lever portion 126 are in the forward positions thereof and for allowing the upper jaw and head assembly 24 to pivot downwardly to a closed position when the slide portion 120 and the pivot lever portion 126 are in the rearward positions thereof.

The golf club 14 and the golf ball 16 are illustrated most clearly in FIG. 1. The golf club 14 comprises an elongated shaft portion 132 having a slideable scorekeeping element 134 thereon and a head portion 136. The shaft portion 132 comprises a bifurcated connecting end portion 38 which is releasably receivable in a tubular sleeve portion 140 of the head portion 136 for releasably connecting the shaft portion 132 to the head portion 136. The golf ball 16 preferably comprises a hollow ball which is integrally molded from a suitable plastic material and adapted to resemble a convention golf ball.

Accordingly, for use and operation of the toy assembly 12, the switch 51 on the apparatus 10 is moved to an "on" position. Assuming that the drive assembly 20 had previously completed an entire cycle of operation, the apparatus 10 is initially disposed in stationary relation with the upper head and jaw assembly 18 in an open position and with the actuator assembly 72 in the position illustrated in FIGS. 5 and 6 so that the contacts 90 and 92 are in spaced relation. Game play is then carried out by striking the ball 16 with the club 14 so that the ball 16 is eventually passed through the open mouth of the character figure embodied in the apparatus 10. Once the ball 16 has passed upwardly along the jaw portion 26, it passes rearwardly through the lower jaw and body assembly 22 until it passes into the rear tall portion 18. Once the ball 16 has passed into the tall portion 28, it rests on the ejector plate 98. The ball 16 is specifically designed so that the weight thereof is just sufficient to cause the ejector plate 98 to be pivoted downwardly so that the finger 102 engages the rear actuator assembly 72 causing the contact 90 to be moved into engagement with the contact 92 and thereby causing temporary energization of the motor 48 and causing the cam 88 to be removed from the notch 96. As the cam gear 66 is then rotated, the cam element 70 eventually passes over the ridge 81 allowing the cam plate 37 to be propelled rearwardly by the spring 78 so that the leg 84 is propelled into engagement with one of the triangular tabs 104 on the ejector assembly 73 and causing the ejector plate 98 to be rapidly pivoted upwardly ejecting the ball 16 in a forward direction from the apparatus 10. Simultaneously, the leg 84 is also propelled into engagement with the left side contact plate 31 causing the rear tail portion 28 to be pivoted upwardly slightly in a simulated tail flipping motion. Still further, when the cam plate 37 is moved rearwardly by the spring 78, the rear leg 82 engages the contact cam 94 causing the contacts 90 and 92 to remain in engagement as long as the cam plate 37 is in the rearward position thereof. Accordingly, the motor 48 remains energized until the cam 70 approaches the ridge 81 in the cam opening 80 causing the cam plate 37 to be returned to the forward position thereof, and during this time, the rotator disk 106 is rotated by the rotator gear 68 to rotate the apparatus 10 on the supporting surface thereof. Further, as long as the cam plate 37 is in the rearward position thereof, the tilt lever assembly 74 is positioned in the retracted position thereof in which the foot 118 is retracted upwardly so that both the foot 118 and the lower jaw portion 28 are normally maintained in spaced relation to the supporting surface thereof whereby the apparatus 10 can freely rotate on the supporting surface thereof. A similar result is achieved if the rotator platform 108 is assembled with the rotator disk 106. In any event, when the cam plate 37 is moved to the rearward position thereof, it also causes the slide portion 120 and the pivot lever portion 126 of the jaw pivot assembly 76 to be moved to the rearward positions thereof causing the upper jaw and head assembly 24 to move to the closed position thereof.

As a result of the above, the apparatus 10 is effectively adapted for use in a highly amusing and exciting golf-type game. In this regard, during the course of game play, game players are required to strike the ball 16 with the club 14 in order to pass the ball 16 into the apparatus 10. Once the ball 16 has passed into the apparatus 10 so that it is received in the rear tail portion 28, the ball 16 is automatically ejected from the apparatus 10, the upper head and jaw portion 24 is automatically lowered to the closed position thereof, and the apparatus 10 is automatically rotated on the supporting surface thereof so as to reorient the apparatus 10 to face in a different direction. Accordingly, during the course of game play, a game player is normally required to strike the ball 16 several times before it can again be passed into the apparatus 10 to achieve a score.

It is seen, therefore, that the instant invention provides an effective game apparatus which is adapted for use in a highly amusing golf-like game. The apparatus 10 is preferably embodied as an animated character figure which is adapted so that when a golf ball is received therein, the character figure closes its mouth, ejects the ball, and turns around several times. It has been found that this has the effect of substantially increasing the overall play value of the apparatus 10, and accordingly, it is seen that the apparatus 10 represents a significant advancement in the prior art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising:

a game element adapted to be propelled along a supporting surface;

a housing including a character figure head portion having upper and lower jaw portions which cooperate to form a mouth, at least one of said upper and lower jaw portions being pivotable for moving said mouth between open and closed positions, said housing being receivable on a supporting surface so that said lower jaw portion rests thereon, said lower jaw portion forming a ramp for receiving said game element in said housing, said ramp leading from the supporting surface to an area behind said mouth when said mouth is in the open position and said character figure is received on the supporting surface so that said lower jaw portion rests thereon; and ejecting means for receiving said game element from said ramp and for automatically ejecting said game element therefrom by tossing it through the air over said head portion.

2. In the game apparatus of claim 1, said character figure comprising a simulated alligator character figure, said game element comprising a simulated golf ball.

3. The game apparatus of claim 1 further comprising means for automatically moving said mouth to the closed position thereof upon the passage of said game element therethrough.

4. In the game apparatus of claim 1, said game element comprising a simulated golf ball.

5. The game apparatus of claim 1 further comprising a simulated golf club.

6. A game apparatus comprising:

a game element adapted to be propelled along a supporting surface;

a housing including a character figure head portion having upper and lower jaw portions which cooperate to form a mouth, at least one of said upper and lower jaw portions being pivotable for moving said mouth between open and closed positions, said housing being receivable on a supporting surface so that said lower jaw portion rests thereon, said lower jaw portion forming a ramp for receiving said game element in said housing, said ramp leading from the supporting surface to an area behind said mouth when said mouth is in the open position and said character figure is received on the supporting surface so that said lower jaw portion rests thereon; and ejecting means for receiving said game element from said ramp and for automatically ejecting said game element therefrom; and means for automatically rotating said housing about a substantially vertical axis after ejecting said game element.

7. In the game apparatus of claim 5, said ejecting means automatically ejecting said game element by tossing it through the air over said head portion.

8. A game apparatus comprising:

a game element adapted to be propelled along a supporting surface;

a housing including a character figure head portion having upper and lower jaw portions which cooperate to form a mouth, at least one of said upper and lower jaw portions being pivotable for moving said mouth between open and closed positions, said housing being receivable on a supporting surface so that said lower jaw portion rests thereon, said lower jaw portion forming a ramp for receiving said game element in said housing, said ramp leading from the supporting surface to an area behind said mouth when said mouth is in the open position and said character figure is received on the supporting surface so that said lower jaw portion rests thereon;

ejecting means for receiving said game element from said ramp and for automatically ejecting said game element therefrom; and means for automatically rotating said housing about a substantially vertical axis after receiving said game element in said housing.

* * * * *